US005286918A

United States Patent [19]

Iwata et al.

[11] Patent Number: 5,286,918

[45] Date of Patent: Feb. 15, 1994

[54] DEVELOPING APPARATUS USING A DEVELOPER CARRIER CAPABLE OF FORMING MICROFIELDS ON THE SURFACE THEREOF

[75] Inventors: Naoki Iwata, Tokyo; Koji Suzuki, Yokohama; Shigekazu Enoki, Kawasaki; Hiroshi Takashima, Yono; Yuichi Ueno, Kawasaki, all of Japan

[73] Assignee: Ricoh Company, Ltd., Tokyo, Japan

[21] Appl. No.: 715,771

[22] Filed: Jun. 14, 1991

[30] Foreign Application Priority Data

Jun. 14, 1990 [JP] Japan ..... 2-155826
Jun. 20, 1990 [JP] Japan ..... 2-159982
Jun. 1, 1991 [JP] Japan ..... 3-157542

[51] Int. Cl.[5] ..... G03G 15/06

[52] U.S. Cl. ..... 118/653; 355/245; 355/259

[58] Field of Search ..... 118/644, 647, 648, 651, 118/653, 657, 658; 355/245, 251, 259, 261, 262

[56] References Cited

U.S. PATENT DOCUMENTS 3,759,222 9/1973 Maksymiak et al. ..... 355/259 X
4,006,981 2/1977 Fantuzzo ..... 118/651 X
4,289,837 9/1981 Gundlach ..... 118/651 X
4,515,106 5/1985 Kohyama ..... 118/651
4,788,570 11/1988 Ogata et al. ..... 355/245
4,896,625 1/1990 Sakamoto et al. ..... 355/245 X
4,982,692 1/1991 Uematsu ..... 355/259 X

FOREIGN PATENT DOCUMENTS 2237407 1/1991 United Kingdom ..... 355/260

*Primary Examiner*—Benjamin R. Fuller
*Assistant Examiner*—J. E. Barlow, Jr.
*Attorney, Agent, or Firm*—Oblon, Spivak, McClelland, Maier & Neustadt

[57] ABSTRACT

A developing apparatus having a rotatable toner carrier for transporting a toner to a developing region where it faces an image carrier on which a latent image has been electrostatically formed. The surface of the toner carrier is constituted by a mixture of conductive surface portions and dielectric surface portions and selectively holds a charge to form microfields. The toner having been charged is electrostatically deposited on the toner carrier by the microfields and transported to the developing region as the toner carrier moves. In the developing region where the toner carrier and the image carrier face each other while defining a developing gap therebetween, the toner electrostatically flies from the toner carrier to the latent image formed on the image carrier to thereby develop it.

8 Claims, 13 Drawing Sheets

DEVELOPING APPARATUS USING A DEVELOPER CARRIER CAPABLE OF FORMING MICROFIELDS ON THE SURFACE THEREOF

BACKGROUND OF THE INVENTION

The present invention relates to a developing apparatus of the type causing a developer carrier to carry and transport a one-component developer to a developing region where the developer carrier faces an image carrier so as to develop a latent image electrostatically formed on the image carrier. More particularly, the present invention relates to a developing apparatus which develops a latent image by use of a developer carrier capable of forming microfields thereon.

A developing apparatus of the type using a powdery dry developer is extensively used with an electrophotographic copier, laser beam printer, facsimile transceriver or similar electrophotographic image forming equipment which electrostatically forms a latent image on an image carrier such as a photoconductive element and develops it by a developer. The powdery developer is available as a two-component developer which is the mixture of a toner and a carrier or a one-component developer which does not contain a carrier. Although a developing apparatus using the two-component developer reproduces attractive images relatively stably, the carrier is apt to deteriorate and the mixture ratio of the toner and carrier is apt to change. This results in troublesome management of the apparatus and a bulky construction. For this reason, a developing apparatus which uses the one-component developer free from the above problem is attracting much attention. The one-component developer is implemented with the toner only or with the toner and an auxiliary agent for controlling the polarity and amount of charge. The toner in turn is implemented as a magnetic toner containing magnetic power therein or a non-magnetic toner which does not contain it. Since a magnetic body is usually opaque, a color image, whether it be full-color or multicolor, developed by the magnetic toner does not appear sharp. Therefore, it is preferable to use the one-component developer constituted by the non-magnetic toner for color images.

In a developing apparatus implemented with a one-component developer, a developing roller or similar developer carrier carries the developer thereon and transports it to a developing region where the developer carrier faces an image carrier. In this region, the developer develops a latent image electrostatically formed on the image carrier. A prerequisite with this type of apparatus is that a great amount of sufficiently charged toner be fed to the developing region in order to insure high quality images having predetermined density. When the magnetic toner is used, a sufficient amount of one-component developer may be deposited on the surface of the developer carrier by magnets. However, the non-magnetic one-component developer is immune to magnetism, so that transporting a great amount of developer to the developing region is difficult.

Various implementations have been proposed in the past for eliminating the above problem. For example, a developing apparatus disclosed in Japanese Patent Laid-Open Publication No. 43767/1986 has a developer carrier covered with an insulative dielectric layer, and a sponge roller or similar developer supply member held in pressing contact with the dielectric layer. The developer carrier and the sponge roller are charged to opposite polarities by friction. A non-magnetic one-component developer charged to the opposite polarity to the dielectric layer is electrostatically deposited on the dielectric layer and transported to a developing region. A drawback with this scheme is that the electric field developed in the vicinity of the surface of the dielectric layer is not intense enough to deposit a great amount of toner on the surface of the developer carrier and, therefore, the developer available in the developing region is short. In this condition, forming a developed image or toner image with high density is not easy. To eliminate this drawback, the developer carrier is moved at a speed twice or more higher speed than the moving speed of the image carrier. This, however, brings about another problem that the density of a solid image formed on the image carrier becomes unusually high in a trailing edge portion of the image with respect to the moving direction of the image carrier, resulting in poor image quality.

Another conventional developing apparatus generates an electric field between the developer carrier and the image carrier in a direction for electrostatically transferring the non-magnetic one-component developer toward the developer carrier. Such an approach, however, also fails to deposit a sufficient amount of developer on the developer carrier.

Japanese Patent Laid-Open Publication No. 51841/1979 teaches another approach which uses a developer supply member for positively causing the non-magnetic developer to electrostatically deposit on the developer carrier. Specifically, after the developer carrier has moved away from the developing region, the non-magnetic one-component developer remaining thereon is scraped off. Then, the surface layer of the developer carrier is applied with a charge by corona discharge. The developer supply member positively and electrostatically deposits the non-magnetic developer on the charged surface of the developer carrier. With this approach, it is impossible to increase the amount of developer carried on the developer carrier and, therefore, to feed a great amount of toner to the developing region.

The developer carrier may be provided with undulations on the surface thereof so as to fill them with the non-magnetic one-component developer, as disclosed in Japanese Patent Laid-Open Publication No. 53996/1985. While such a configuration may be successful in increasing the amount of developer to reach the developing region, such a developer contains a substantial amount of toner whose charge is short and, therefore, cannot produce high quality images.

Further, Japanese Patent Publication No. 9711/1980 proposes a developing apparatus having a developer carrier made up of a conductive support member, an insulating layer provided on the support member, and a conductive lattice member provided on the insulating member. The insulating layer is exposed to the outside through numerous openings formed through the lattice member. A voltage opposite in polarity to a developer is applied between the lattice member and the support member to generate microfields, so that a great amount of developer may be deposited on the surface of the developer carrier by the microfields. However, such microfields are not attainable without resorting to at least an exclusive external power source, resulting in a complicated construction. Other approaches for generating microfields are taught in U.S. Pat. No. 3,739,748 (Rittler et al), U.S. Pat. No. 3,645,618 (Lancia et al), U.S. Pat. No. 3,759,222 (Maksymiak et al), and "Microfield Donors for Touchdown Development" by P. G. Andrus et al, SPSE 2nd International Conference on Electrophotography, October 1973.

Invention for eliminating the above problems are disclosed in our pending U.S. patent application Ser. No. 07/597,881 Filed Oct. 12, 1990 and our pending U.S. patent application Ser. No. 07/674,161 filed Mar. 25, 1991. The present invention constitutes a further improvement over such prior inventions.

SUMMARY OF THE INVENTION

It is therefore an object of the present invention to provide a developing apparatus capable of depositing a great amount of one-component developer on a developer carrier by use of numerous microfields and causing the developer carrier to transport it to a developing region for developing a latent image electrostatically formed on an image carrier.

In accordance with the present invention, in a developing apparatus comprising a movable developer carrier which has a mixture of conductive surface portions and dielectric surface portions on the surface thereof, selectively holds a charge on the surface to form microfields, electrostatically retains a developer on the surface due to the microfields, transports the developer to a developing region where the developer carrier faces an image carrier, and develops a latent image electrostatically formed on the image carrier by the developer, the developer carrier and image carrier forming the developing region are spaced apart by a predetermined developing gap such that in the developing region the developer retained on the surface of the developer carrier electrostatically flies to the latent image to develop it.

Also, in accordance with the present invention, in a movable developer carrier for forming a charge pattern on the surface thereof and electrostatically retaining a developer on the surface due to microfields developed by the charge pattern, assuming that the charge pattern has a pitch $P_1$ in a direction in which the developer carrier is movable and a pitch $P_2$ in a direction perpendicular to that direction, a relation $P_1 > 2P_2$ is satisfied.

DESCRIPTION OF THE PREFERRED EMBODIMENTS

Figure 1:
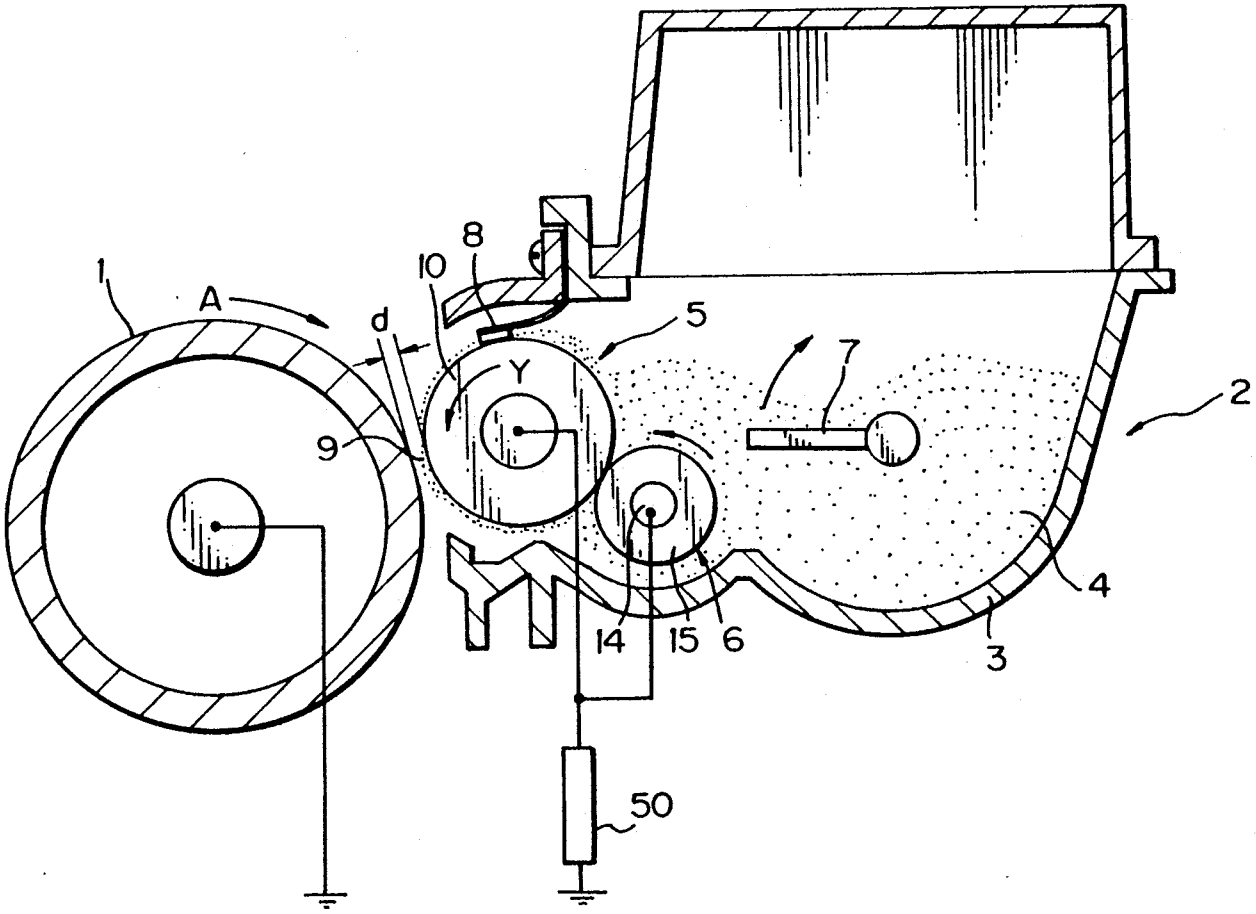
FIG. 1 is a generalized sketch of the developing apparatus according to the present invention.

Referring to FIG. 1 of the drawings, a developing apparatus embodying the present invention is shown and generally designated by the reference numeral 2. As shown, the developing apparatus 2 is located to face a photoconductive element or image carrier in the form of a drum 1. The drum 1 is rotatable in a direction indicated by an arrow A in the figure. The developing apparatus 2 has a casing or receptacle 3 containing a non-magnetic toner with or without an auxiliary agent mixed therewith i.e., a non-magnetic one-component developer. The toner has a volume resistivity of, for example, on the order of $10^7$ Ωcm to $10^{12}$ Ωcm. A developing roller 5 is supported by opposite side panels of the casing 3 while being partly exposed to the outside through an opening formed in the casing 3. Facing the drum 1, the roller 5 is rotated counterclockwise, i.e., in a direction indicated by an arrow Y in the figure. It is to be noted that the developing roller 5 is a specific form of a toner or developer carrier and may be replaced with an endless belt, if desired. A toner supply roller 6 is also supported by the opposite side panels of the casing 3 and plays the role of a toner supply member. The toner supply roller 6 is rotated counterclockwise, for example, while contacting the developing roller 5. An agitator 7 is disposed in the casing 3 and rotatable clockwise to convey the toner 4 toward the toner supply roller 6 while agitating it. The toner 4 is transferred from the toner supply roller 6 to the developing roller 5. At this instant, the toner is frictionally charged to predetermined polarity, i.e., positive or negative polarity (negative polarity in the embodiment). As a result, the toner is electrostatically deposited on the periphery of the developing roller 5. The construction and operation for implementing such a manner of toner deposition will be described in detail later. While the developing roller 5 conveys the toner deposited thereon, a doctor blade 8 regulates the thickness of the toner layer formed on the roller 5. The doctor blade 8 is a specific form of a member for so regulating the thickness of the toner layer and may be replaced with a roller or a belt. As the toner carried on the developing roller 5 reaches a developing region 9 where the roller 5 faces the drum 1, it is electrostatically transferred to a latent image electrostatically formed on the drum 1 to develop the latent image. At this instant, the drum 1 and roller 5 move in the same direction in the position where they are closest to each other. The toner moved away from the developing region 9 without contributing to the development is returned to the toner supply roller 6 by the developing roller 5. The developed image or toner image formed on the drum 1 is transferred to a recording sheet, not shown, and then fixed by a fixing apparatus.

Figure 2:
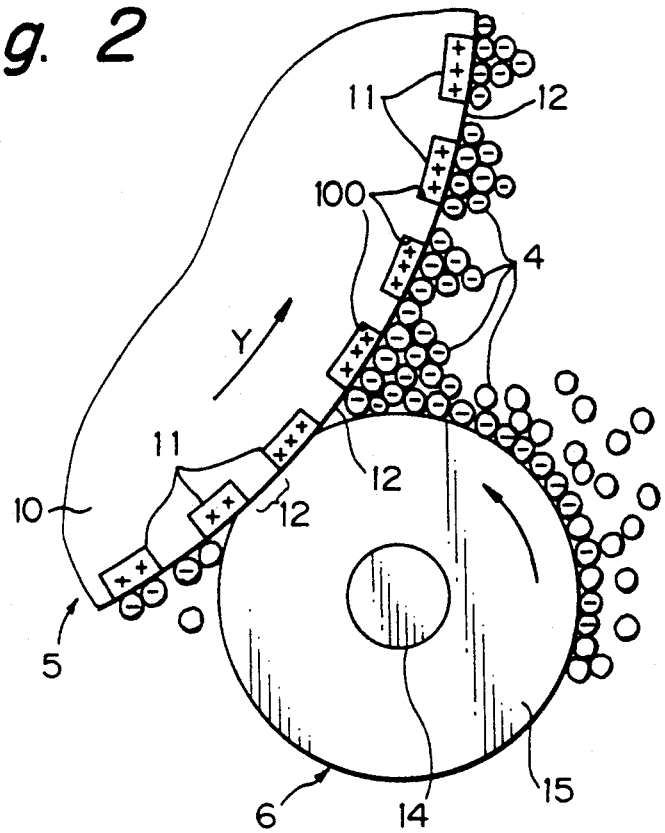
FIG. 2 details the mechanism for the formation of the attraction of toner particles to the developer carrier.
Figure 3:
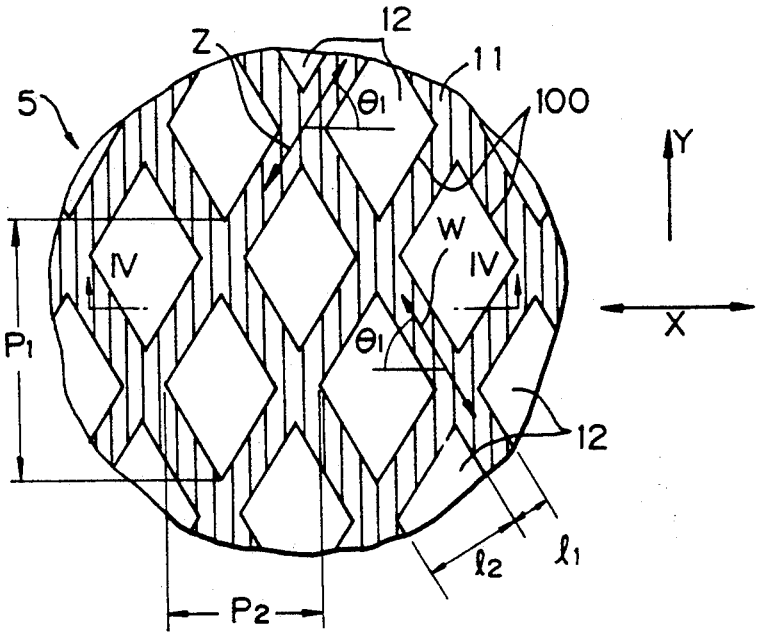
FIG. 3 is an example of one configuration for patterns formed by the conductive surface portions and dielectric body.
Figure 4:
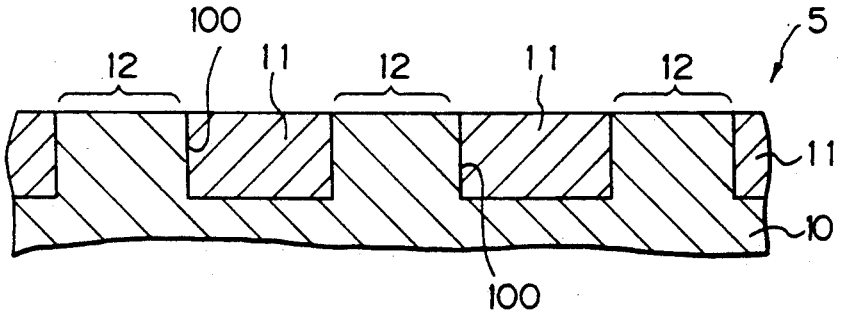
FIG. 4 shows a view taken along line IV of FIG. 3.
Figure 6:
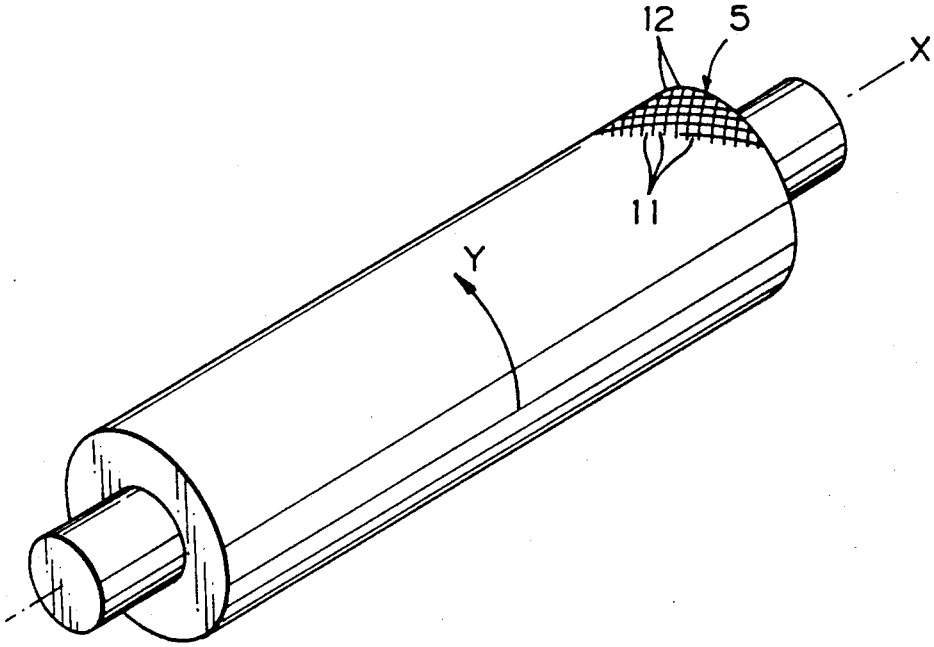
FIG. 6 is a perspective illustrating a portion of a surface of the developer carrier utilizing dielectric and conductive surface patterns similar to FIG. 3.

The above-described construction itself is identical with the construction of a conventional apparatus and cannot readily transport a great amount of sufficiently charged toner to the developing region 9. In the illustrative embodiment, as shown in FIGS. 2 through 4, the developing roller 5 is made up of a base in the form of a conductive roller 10, and dielectric bodies 11 buried in grooves 100 which are formed in the surface of the roller 10. The conductive roller 10 may be made of aluminum, for example. The conductive surface portions 12 of the conductive roller 10 and the surfaces of the dielectric bodies 11 appear in a regular or irregular pattern on the surface of the developing roller 5. In the embodiment, they appear in a regular pattern and are smoothed, as shown in FIG. 3 (see FIG. 6 also). The configuration of the dielectric bodies 11 on the surface of the developing roller 5 is open to choice, as will be described later. In the specific configuration shown in FIG. 3, a great number of dielectric bodies 11 having the same width extend in directions Z and W on the the surface of the developing roller 5. In FIG. 3, X and Y indicate respectively the axial direction of the developing roller 5 and the rotating direction of the roller 5, i.e., the direction in which the surface of the roller 5 moves (circumferential direction). The widths $l_1$ and $l_2$ of the dielectric bodies 11 and conductive surfaces portions 12, respectively, are smaller than 1 mm, for example, and usually as small as 30 μm to 500 μm.

In FIG. 3, the dielectric bodies 11 are indicated by hatching in distinction from the conductive surface portions 12. This is also true with FIGS. 7, 8, 26 and 27. Regarding the dielectric bodies 11, the embodiment uses a material which frictionally charges to polarity opposite to the polarity of the toner, i.e., to positive polarity.

On the other hand, the toner supply roller 6 contacting the developing roller 5 is made of a material which frictionally charges the dielectric bodies 11 to positive polarity in contact therewith and, at the same time, frictionally charges the toner to negative polarity. In FIGS. 1 and 2, the toner supply roller 6 consists of a conductive core 14 and a layer of foam material 15 provided on the core 14. The foam layer 15 is pressed against the developing roller 5 while being elastically deformed. The foam layer 15 is made of a material which frictionally charges the dielectric bodies 11 to positive polarity and the toner to negative polarity, as stated above. The foam layer 15 may be replaced with a fur brush or similar implement which per se is conventional.

In operation, the portion of the developing roller 5 moved away from the developing region 9 reaches the toner supply roller 6 and contacts it. The toner supply roller 6 removes the toner remaining on the developing roller 5 mechanically and electrically. At the same time, the dielectric bodies 11 on the developing roller 5 contacts the toner supply roller 6 and is charged by the latter to positive polarity opposite to the polarity of the toner. Even when an electostatic residual image remains on the dielectric bodies 11 moved away from the developing region 9 due to the latent image of the drum 1, the dielectric bodies 11 are charged substantially to saturation in contact with the toner supply roller 6. As a result, the charge distribution on the dielectric bodies 11 becomes uniform to erase the residual image, whereby the developing roller 5 is initialized. As shown in FIG. 2, the toner 4 being carried by the toner supply roller 6 toward the developing roller 5 is negatively charged due to the friction with the roller 6. On reaching the developing roller 5, the negatively charged toner 4 is further negatively charged in contact with the dielectric bodies 11 of the roller 5. At this instant, the dielectric bodies 11 of the developing roller 5 have been positively charged due to their friction with the toner supply roller 6, and the great number of small conductive surface portions 12 are connected to ground or a bias power source. Positive charge is selectively held in the portions of the developing roller where the dielectric bodies 11 are present. Consequently, a charge pattern corresponding to the surface configuration of the dielectric bodies 11 is formed on the surface of the developing roller 5.

Figure 5:
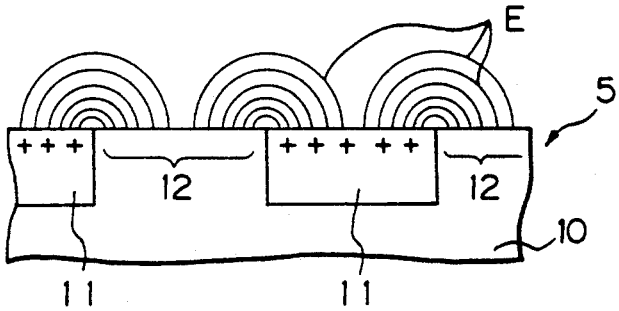
FIG. 5 shows the electric field lines of formation for the microfields.

As a result, as shown in FIG. 5, a substantial potential difference is developed between each conductive surface portion 12 and the surface of the adjoining dielectric body 11, producing a closed electric field. Specifically, the above-stated charge pattern produces numerous small closed electric fields, i.e., microfields in close proximity to the surface of the developing roller 5. More specifically, assuming electric lines of force representative of the condition of an electric field, electric lines of force E are formed in the space adjacent to the surface of the developing roller 5, as indicated by numerous arcs in FIG. 5. The electric lines of force E extend from the developing roller 5 and return to the same roller 5. In this manner, electric fields having a substantial gradient are developed in the vicinity of the developing roller 5. Since the surfaces of the dielectric bodies 11 and the conductive surface portions 12 each having a small area adjoin, the microfields each is extremely intensified by the so-called edge effect or fringing effect. As a result, the negatively charged toner is strongly attracted toward the surfaces of the dielectric bodies 11 by the coulomb force and thereby firmly retained on the developing roller 5. The toner has been intensely charged due to the friction of the rollers 5 and 6 and is retained on the surface of the roller 5 by the intense microfields. Consequently, a great amount of intensely charged toner is deposited on the surface of the developing roller 5. Even when toner particles not sufficiently charged exist in the toner so carried on the developing roller 5, they are removed from the roller 5 by the doctor blade 8 and, therefore, only the sufficiently charged toner particles are transported to the developing region 9 in a greater amount than in a conventional apparatus.

In the developing region 9, the electric fields between the developing roller 5 and the drum 1 are enhanced as to the electrode effect to promote the transfer of the toner from the developing roller 5 to the drum 1. This insures efficient development.

While all the microfields shown in FIG. 5 are closed, it may occur that electric fields which are not closed exist among such closed microfields. Nevertheless, since closed electric fields do exist, the intensity is enhanced to allow a great amount of toner to be carried on the developing roller 5. For example, the developing roller 5 can transport more than 0.6 mg/cm$^2$ to 2.0 mg/cm$^2$ of toner, preferably 0.8 mg/cm$^2$ to 1.2 mg/cm$^2$ of toner, having been charged to about 8 μc/g to 15 μc/g to the developing region 9. Hence, the toner, whether it be a black toner or a color toner, can form a desirable toner image. The amount of toner which a conventional developing roller can transport to a developing region is usually not more than about 0.1 mg/cm$^2$ to 0.3 mg/cm$^2$.

As stated above, the embodiment allows the developing roller 5 to transport a great amount of sufficiently charged toner to the developing region 9, making it needless to increase the linear velocity of the developing roller 5. Specifically, even if the linear speed of the developing roller 5 is close to or equal to that of the drum 1, a sufficient amount of toner is brought to the developing region 9, preventing the density of the toner image from becoming short. When the linear velocities of the drum 1 and roller 5 are so selected, the previously discussed concentration of toner at the trailing edge of a latent image is reduced or eliminated, further enhancing the quality of toner image.

Figure 7:
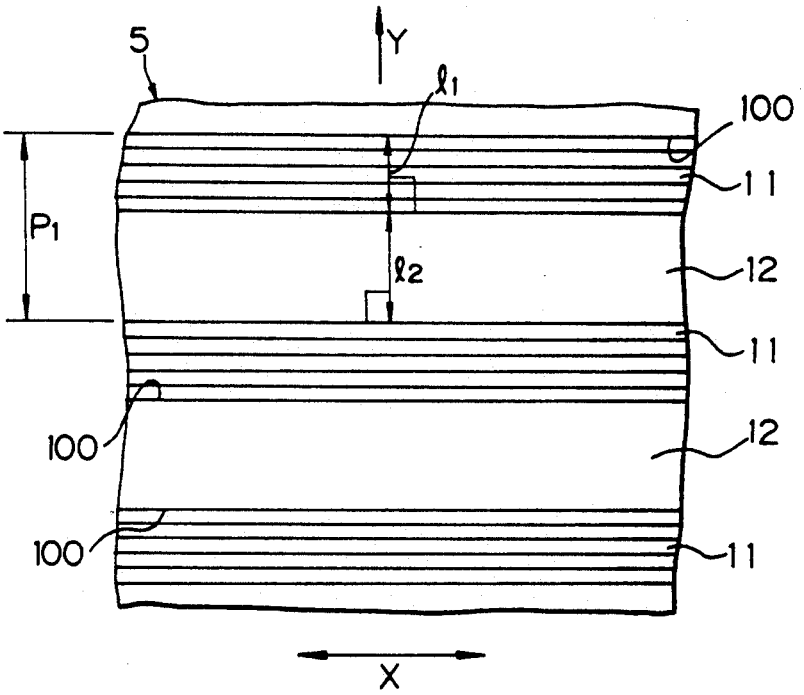
FIGS. 7 and 8 illustrate additional patterns formed by combinations of dielectric surfaces and conductive surface.
Figure 8:
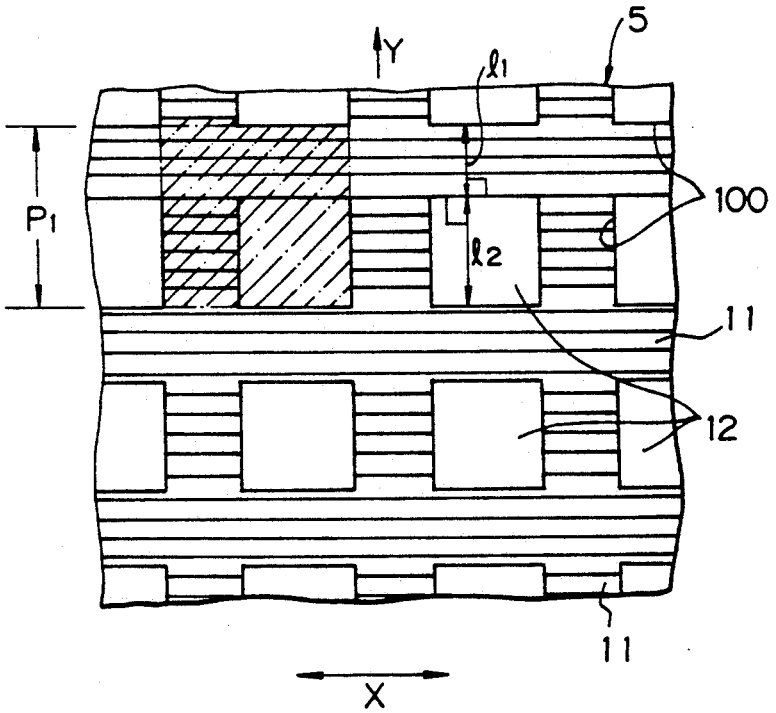
Figure 26:
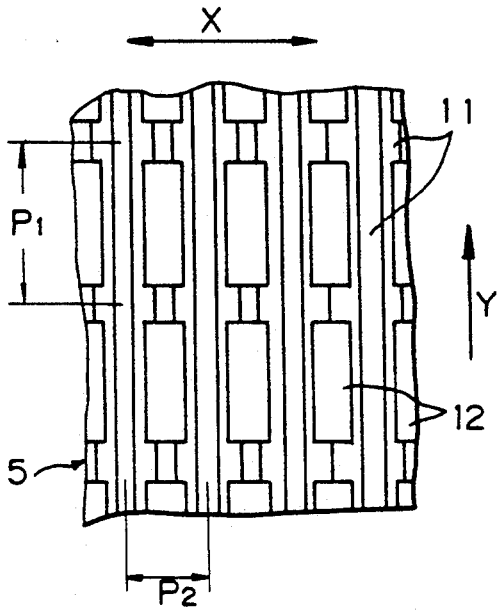
FIG. 26 is construction showing the dielectric bodies arranged in a lattice configuration and extending in the rotating direction of the developer.
Figure 27:
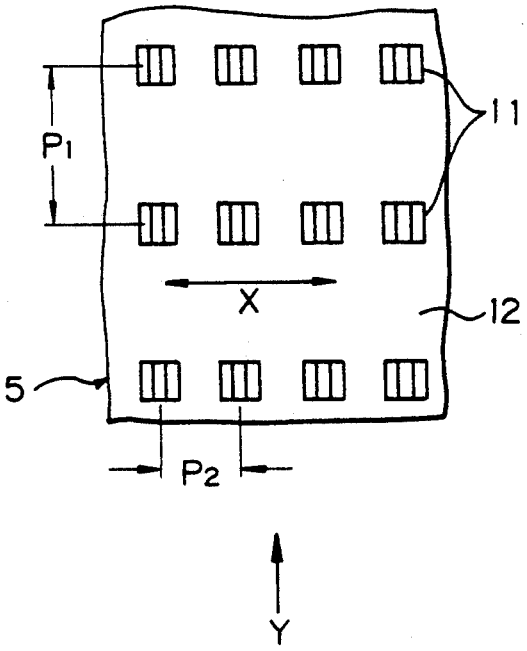
FIG. 27 is another embodiment for dielectric body arrangement with the bodies having a rectangular circular or other suitable shape regularly arranged in both the X and Y directions.

FIG. 7 shows another specific configuration of the dielectric bodies 11, as viewed on the surface of the developing roller 5. As shown, the dielectric bodies 11 extend parallel to each other in the axial direction X of the developing roller 5, while the conductive surface portions 12 each exists between the nearby dielectric bodies 11. Alternatively, as shown in FIG. 8, the dielectric bodies 11 may be arranged in a lattice configuration extending in the rotating direction Y and axial direction X of the developing roller 5. In any case, a charge pattern corresponding to the pattern of the dielectric bodies 11 is developed on the surface of the developing roller 5, generating microfields in the previously stated manner. FIGS. 26 and 27 each shows another specific arrangement of the dielectric bodies 11 and conductive surface portions 12 on the developing roller 5. The gist is that microfields for carrying a great amount of toner should be developed.

When the linear velocity of the surface of the developing roller 5 is close to or equal to that of the drum 1, the toner is prevented from concentrating at the rear edge of a latent image, as stated above. However, such a linear velocity of the developing roller 5 is likely to bring about another problem, as follows. In the apparatus shown in FIG. 2, a great amount of toner deposits on the surfaces of the dielectric bodies 11 due to the microfields, usually in three to five consecutive layers, but the toner does not deposit on the conductive surface portions 12 at all or it deposits only in one layer at most. That is, it is difficult to deposit the toner in a fully uniform distribution on the entire developing roller 5. More specifically, the toner deposits on the roller surface in an irregular distribution matching the pattern of the dielectric bodies 11 and conductive surface portions 12 on the roller surface. Hence, when the developing roller 5 is rotated at the same or substantially the same linear velocity as the drum 1, it is likely that a solid toner image formed on the drum 1 over a substantial area suffers from minute traces corresponding to the irregular distribution of toner on the developing roller 5. Such traces will be not be conspicuous if the dielectric bodies 11 and conductive surface portions 12 appearing on the surface of the developing roller 5 are arranged irregularly. Regarding the production cost and accuracy of the developing roller 5, it is preferable to form grooves 100 in the surface of the conductive roller 10 by knurling or similar technology and to bury the dielectric bodies in the grooves 100. However, since such grooves 100, i.e., the dielectric bodies 11 appear regularly on the surface of the developing roller 5, as shown in FIGS. 3, 7 or 8, a minute pattern ascribable to knurling is apt to appear as irregularities in a solid toner image having a substantial area. The irregularities in the toner image would also appear in an image transferred to a recording sheet and would remain even after fixation. To meet the increasing demand for a miniature printer or copier, it is necessary to reduce the diameter of the drum 1 and that of the developing roller 5. Further, to enhance the sharpness of an image, it is preferable to reduce the gap between the developing roller 5 and the drum 1. Such a configuration, however, aggravates the tendency that the pattern on the developing roller 5 appears as irregularities or traces in a solid image.

In light of the above, the illustrative embodiment configures the toner carrier, as follows. As shown in FIG. 1, in the developing region 9, the developing roller 5 and the drum 1 face each other with the intermediary of a small gap d for development. In such a developing region 9, the toner 4 carried on the developing roller 5 electrostatically flies away from the roller 5 and deposits on the latent image formed on the drum 1 to thereby develop the latent image. This kind of development is generally referred to as non-contact development. While the toner 4 flies from the developing roller 5 toward the drum 1, it scattered, as indicated by arrows in FIG. 9. As a result, the toner deposits even on the portions of the latent image corresponding to the conductive surface portions 12 which retain hardly any toner thereon. More specifically, the toner flying the space in the developing region 9 is more likely to deposit in the portions of the latent image where the toner is absent and, therefore, the surface potential is high than to deposit in the other portions where the toner has already deposited and, therefore, the surface potential has been reduced. Consequently, despite the irregular toner distribution on the developing roller, the toner distribution on the latent image is regular and, therefore, frees the toner image from the traces. Thus, even if the linear velocity of the developing roller 5 is close to or equal to that of the drum 1, the pattern on the surface of the roller 5 is prevented from appearing as irregularities in a toner image, especially a solid toner image having a substantial area.

In the event of non-contact development described above, the conductive roller 10 of the developing roller 5 may be connected to ground or, alternatively, a DC voltage, an alternating voltage (e.g. AC or pulse voltage) or a superposed voltage thereof may be applied to the roller 10 to enhance the quality of the toner image. In FIG. 1, a power source 50 applies a superposed voltage of DC and alternating voltage to the developing roller 5. This is also true with the toner supply roller 6. In this case, a rectangular pulse voltage whose frequency is 300 Hz to 2,000 Hz, preferably 500 Hz to 1,500 Hz may be superposed on a DC voltage of the same polarity as the charge of the latent image formed on the drum 1 and applied to the developing roller 5. This is successful in enhancing the sharpness of the toner image. This kind of scheme is also desirably applicable to other embodiments which will be described.

Figure 9:
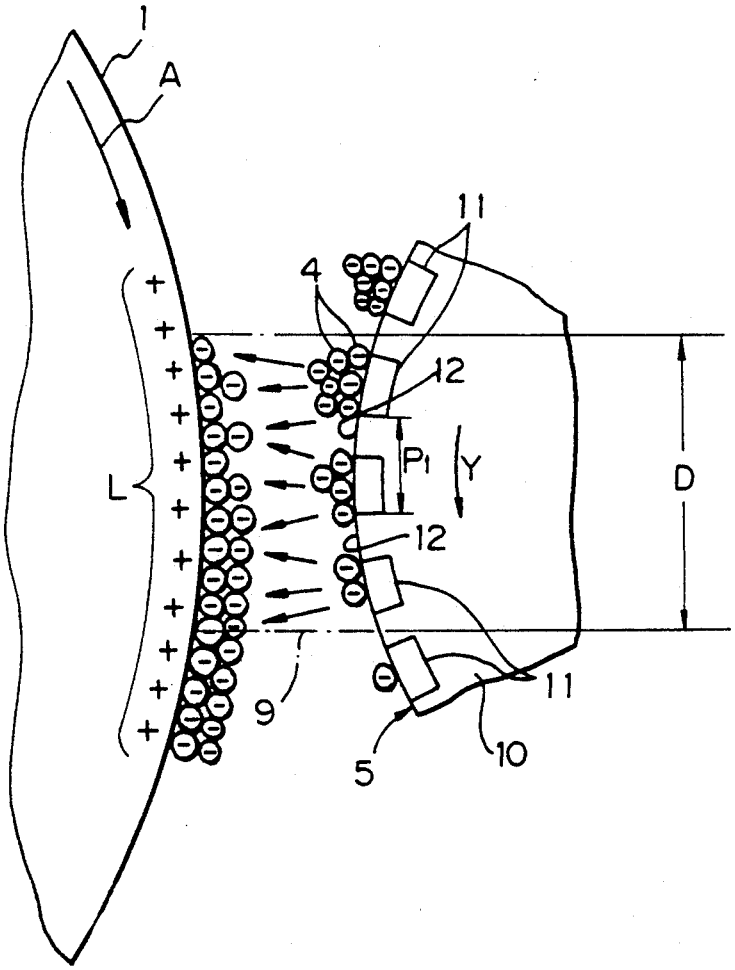
FIG. 9 details the toner transfer occurring in the developer region according to the present invention.

To free the toner image from the irregularities or traces more effectively, the arrangement for non-contact development described above should preferably be accompanied by the following configuration. As shown in FIG. 9, the negatively charged toner 4 deposited in a great amount on the surfaces of the dielectric bodies 11 fly in the developing region 9 toward the latent image L of positive polarity formed on the drum 1. The words "developing region 9" refers to a range wherein the toner 4 can fly from the developing roller 5 toward the latent image L on the drum 1 due to the electric fields developed between the drum 1 and the roller 5, as indicated by dash-and-dot lines in FIG. 9. Assume that the developing region 9 has a width D as measured in the rotating direction Y of the developing roller 5. Then, in the condition shown in FIG. 9, a plurality of dielectric bodies 11 exist in the width D. When two or more dielectric bodies 11 are present in the width D and the surfaces thereof and the conductive surface portions 12 exist together in the developing region 9, the toner 4 flying toward the latent image L is moderately scattered. As a result, the toner deposits even in the portions of the latent image L corresponding to the conductive surface portions 12 which retain the toner little or do not retain it at all. As shown in FIGS. 7, 8, 26 and 27, assume that the pattern formed by the dielectric bodies 11 and conductive surface portions 12 has a pitch $P_1$ in the rotating direction Y of the developing roller 5. Then, to cause two or more dielectric bodies 11 to exist in the width D at the same time, the pitch P and the width W are so selected as to satisfy a relation $P_1 < D$. Especially, when $P_1$ is equal to or smaller than D/2, the flying toner will scatter more effectively.

Figure 10:
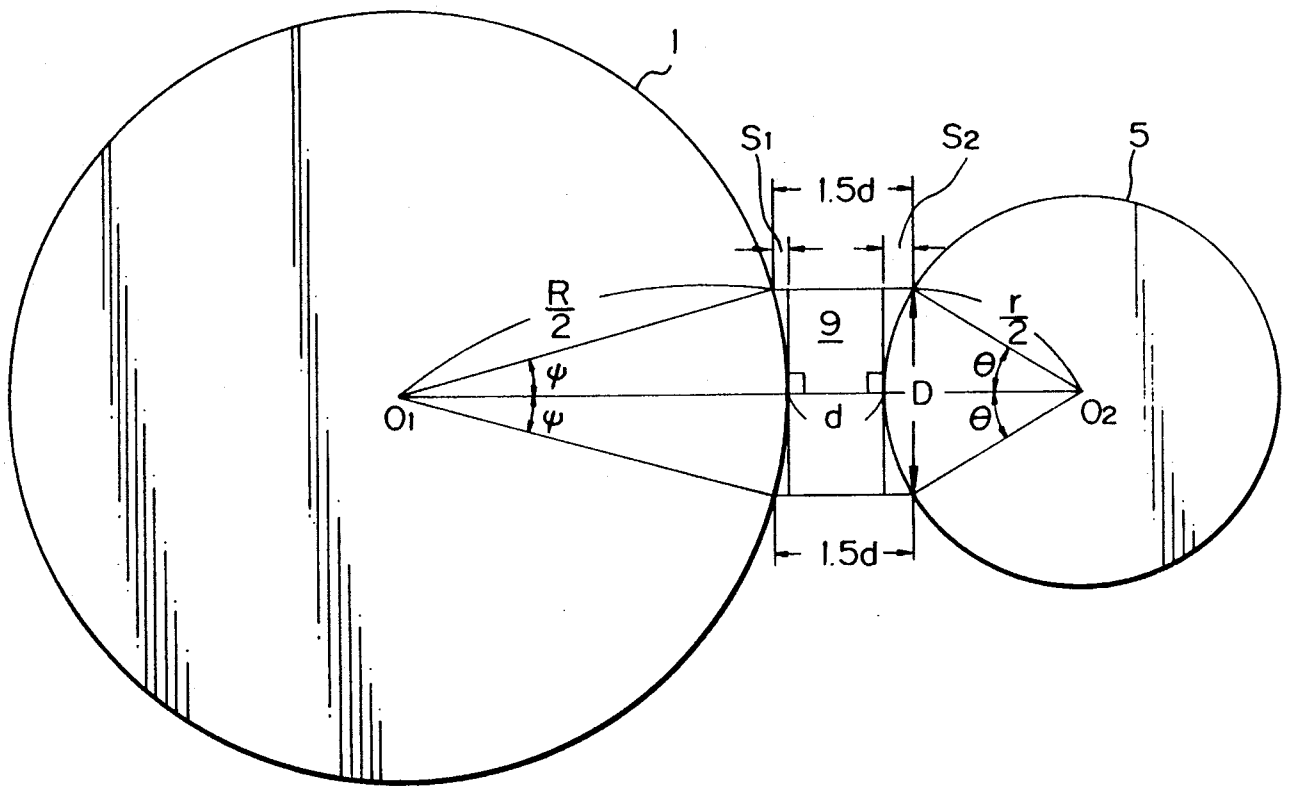
FIG. 10 shows the geometrical relationship between the radius of the developer carrier and the image carrier in the formation of the spacing d between the carriers and the diameter of the developing region 9.

Hereinafter will be described a more specific arrangement for implementing the pattern pitch $P_1$ which is equal to or smaller than D/2. To cause the toner to fly from the developing roller 5 in the developing region 9, an electric field intense enough to allow the toner to fly has to be developed between the roller 5 and the drum 1. Such an electric field depends on the bias voltage applied to the roller 5, the gap between the roller 5 and the drum 1, and the surface potential of the latent image formed on the drum 1. When the width D of the developing region 9 is excessively small or excessively large, a toner image of high quality is not attainable. Experiments showed that assuming that the shortest distance, i.e., the gap d between the drum 1 and the roller 5, FIG. 10, is 0.05 mm to 0.5 mm as with ordinary non-contact development, selecting the range wherein the distance between the roller 5 and the drum 1 is up to 1.5 times as great as the gap d, i.e., 1.5 d as the developing region 9 is successful in forming high quality toner images. The width D of such a desirable developing region 9 can be determined by use of the following arithmetic operations.

As shown in FIG. 10, assume that the developing roller 5 has a diameter r, the drum 1 has a diameter R, and the center angles of the drum 1 and roller 5 each containing the width D are $2\phi$ and $2\theta$, respectively. The centers of the drum 1 and roller 5 are labeled $O_1$ and $O_2$, respectively. The distance between the drum 1 and the roller 5 at the upper and lower ends of the developing region 9 is 1.5 d and greater than the gap d by distances $S_1$ and $S_2$, FIG. 10:

$$d + S_1 + S_2 = 1.5\,d \qquad \text{Eq. (1)}$$

As shown in FIG. 10, $$S_1 = \frac{R}{2} - \frac{R}{2}\cos\phi = \frac{R}{2}(1 - \cos\phi) \qquad \text{Eq. (2)}$$

$$S_2 = \frac{r}{2}(1 - \cos\theta) \qquad \text{Eq. (3)}$$

Hence, from the Eqs. (1), (2) and (3), $$\frac{d}{2} = \frac{R}{2}(1 - \cos\phi) + \frac{r}{2}(1 - \cos\theta) \qquad \text{Eq. (4)}$$

Further, as seen from FIG. 10, $$\frac{R}{2}\sin\theta = \frac{r}{2}\sin\theta \qquad \text{Eq. (5)}$$

Since $d << R$, r, $d^2 \approx 0$, from the Eqs. (4) and (5), $$\cos\theta \div 1 - \frac{Rd}{r(R + r)}$$

Therefore, the width D is expressed as:

$$D = r\sin\theta \div \sqrt{\frac{2Rrd}{R + r}}$$

The width d and the pattern pitch $P_1$ need only to satisfy the relation $P_1 \leqq D/2$, as stated earlier. Hence, if $$P_1 \leqq \sqrt{\frac{Rrd}{2(R + r)}} \qquad \text{Eq. (6)}$$

is satisfied, even when the drum 1 has a diameter of about 10 mm to about 200 mm and such a drum 1 and the developing roller 5 are rotated at substantially the same linear velocity, the pattern of dielectric bodies 11 and conductive surface portions 12 of the roller 5 is prevented from appearing in a toner image as the irregularities or traces.

Figure 11:
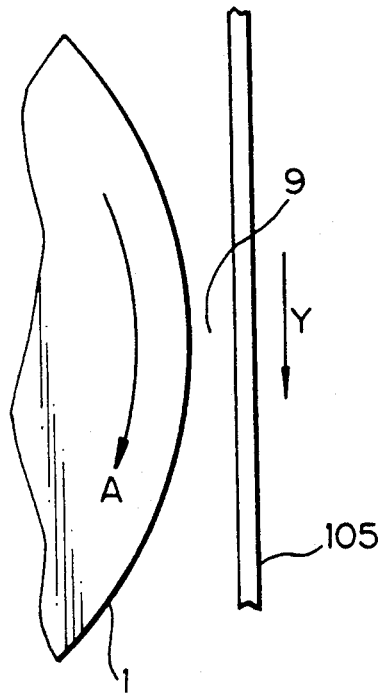
FIGS. 11 and 12 show embodiments in which the developer carrier and the image carrier are respectively flat elongated belts.

As shown in FIG. 11, assume that the toner carrier is implemented as an endless belt 105. Even the endless belt 105 can form microfields if dielectric bodies are buried in the conductive sheet-like base thereof in the manner shown in FIGS. 3, 7 or 8. As shown in figure, when the belt 105 faces the drum 1 in a flat position, the radius of the belt 105 corresponding to the radius r/2 of the developing roller 5, FIG. 10, is infinite. Therefore, the Eq. (6) is rewritten as:

$$P_1 \leqq \sqrt{\frac{Rd}{2}} \qquad \text{Eq. (7)}$$

Figure 12:
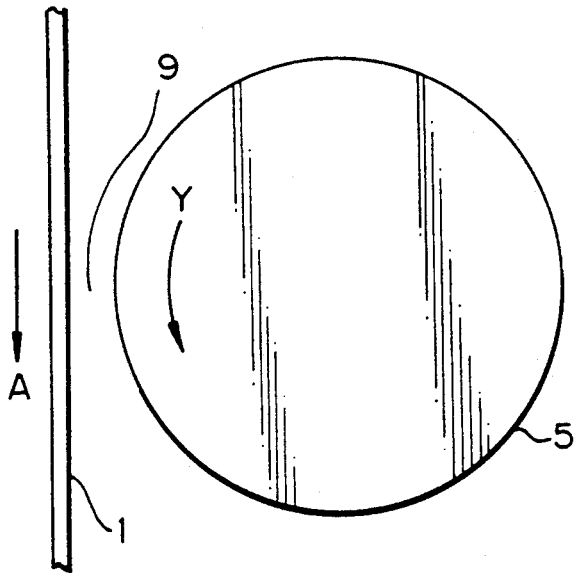

Conversely, as shown in FIG. 12, when the photoconductive element 1 is implemented as a belt and faces the developing roller 5 in a flat position, the radius of the element 1 is infinite. Then, the Eq. (6) is rewritten as:

$$P_1 \leqq \sqrt{\frac{rd}{2}} \quad \text{Eq. (8)}$$

Even when both of the photoconductive element and toner carrier are implemented as a belt, the above-described advantage is attainable if $P_1 < D$, preferably $P_1 \leqq D/2$, is satisfied.

To prevent the pattern of the developing roller 5 or that of the belt 105 from appearing in the toner image as the traces more positively, the following condition should preferably be satisfied in addition to the above-described condition. Specifically, as the portion intervening between nearby dielectric bodies 11, i.e., the area of each conductive surface portion 12 increases, it becomes difficult to cause the toner to deposit on the portions of the latent image corresponding to the conductive surface portions 12 even if the relation $P_1 < D$, especially $P_1 \leqq D/2$ is satisfied. In the illustrative embodiment, the ratio of the total area of the dielectric bodies 11 to the entire surface of the developing roller 5 (or belt 105) is selected to range from 40% to 95%, preferably 60% to 80%. This insures desirable microfields without increasing the area of each conductive surface portion 12 intervening between the dielectric bodies 11 to an excessive degree.

The configurations described above are applicable to a developing apparatus of the type charging the surface of a photoconductive element to the same polarity as a toner, selectively exposing the charged surface to reduce the amount of charge and thereby electrostatically forming a latent image, and causing a toner to fly to the latent image to develop it. This is also true with other embodiments which will be described.

More specific configurations are as follows. Assume that the drum 1 is implemented as an organic photoconductive element, charged to negative polarity contrary to the charge shown in FIG. 9, and then exposed to electrostatically form a latent image thereon, and that the latent image is subjected to negative-to-positive development which uses a negatively charged toner. The developing roller 5 and the drum 1 are spaced apart by a gap of 0.12 mm and rotated at the same linear velocity of 150 mm/sec. The power source 50 applies a pulse bias voltage to the developing roller 5, toner supply roller 6 and doctor blade 8 to equalize their potentials. The waveform of this pulse bias voltage has 0 V portions each having a duration of 0.8 msec and −900 V portions each having a duration of 0.8 msec. The toner 4 has a charge (Q/M) of −12 μc/g as measured in the developing region 9. The threshold electric field causing the transfer of toner to occur in the developing region 9 is higher than 5,000 V/mm. The drum 1 and the roller 5 have diameters of 28 mm and 14 mm, respectively. In this condition, the developing region 9 extends over a width D (FIG. 10) of approximately 1.5 mm. The conductive roller 10 of the developing roller 5 is implemented by an aluminum pipe, and the surface thereof is knurled to form 0.15 mm wide and 0.1 mm deep grooves 100 at a pitch of 0.3 mm and in the pattern shown in FIG. 3. The grooves 100 each extends at an angle of $\theta_1$ (FIG. 3) of 45° with the axial direction X of the roller 5. Fluoric resin is applied to the knurled surface of the conductive roller 10, and then the surface of the roller 10 is machined to expose the conductive surface portions 12 and the surfaces of the dielectric bodies 11. Since the pattern pitch $P_1$ in the rotating direction Y of the roller 5 is 0.42 mm, the relation $P_1 \leqq D/2$ is satisfied. The ratio of the total area of the dielectric bodies 11 to the entire surface of the developing roller 5 is 75%.

Experiments showed that the above specific conditions effectively prevent the irregularities corresponding to the pattern provided on the surface of the developing roller 5 from appearing in a solid toner image having a substantial area.

The embodiments have been shown and described as charging the surface of the developing roller 5 or the belt 105 to the opposite polarity to the toner 4. Alternatively, the dielectric bodies 11 may be changed to the same polarity as the toner to retain the toner on the conductive surface portions 12. This is also successful in achieving the above-described advantages if the pattern pitch $P_1$ and the width D of the developing region are selected as stated above. Since such an alternative scheme causes a great amount of toner to deposit on the conductive surface portions 12 instead of the dielectric bodies 11, it is preferable that the ratio of the total area of the conductive surface portions 12 to the entire area of the toner carrier 5 or 105 be 40% to 95%, desirably 60% to 80%.

Another specific construction for freeing the toner image from irregularities will be described. Basically, the construction which will be described is similar to the construction described with reference to FIGS. 1 through 8. Again, as shown in FIGS. 3, 7 or 8, the surfaces of the dielectric bodies 11 and the conductive surface portions 12 appear in a regular pattern on the surface of the developing roller 5, and the dielectric bodies 11 are charged to the opposite polarity to the toner to retain the toner thereon. The toner is transported to the developing region 9 to effect non-contact development. The difference is that, as shown in FIGS. 3, 7 or 8, the width $l_2$ of each conductive surface portion 12 and the gap d, FIG. 1, which is the shortest distance between the drum 1 and the roller 5 are selected to satisfy a relation $d > l_2$. With this configuration, it is possible to prevent the irregularities ascribable to the pattern of the developing roller 5 from being reproduced in the toner image even when the roller 5 is rotated at the same or substantially the same linear velocity as the drum 1. This is based on the results of experiments which will be described hereinafter.

For experiments, the specific pattern shown in FIG. 8 was used. In FIG. 8, the surface of each dielectric body 11 has the width $l_1$, while each conductive surface 12 has the width $l_2$. Here, the widths $l_1$ and $l_2$ are respectively representative of the shortest distance between nearby conductive surface portions 12 and the shortest distance between the nearby dielectric bodies 11. This is why the symbol representative of right angle accompanies the arrows which indicate the widths $l_1$ and $l_2$.

Figure 13:
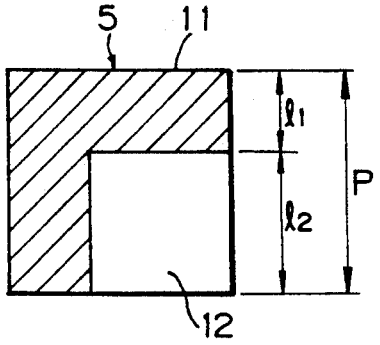
FIGS. 13–19 show various rollers having a pattern of FIG. 8.

FIG. 13 shows a unit portion of the pattern of FIG. 8 made up of the dielectric bodies 11 and conductive surface portions 12, i.e., a portion indicated by hatching in FIG. 8. In FIG. 13, the pitch P is the sum of the widths $l_1$ and $l_2$.

Figure 14:
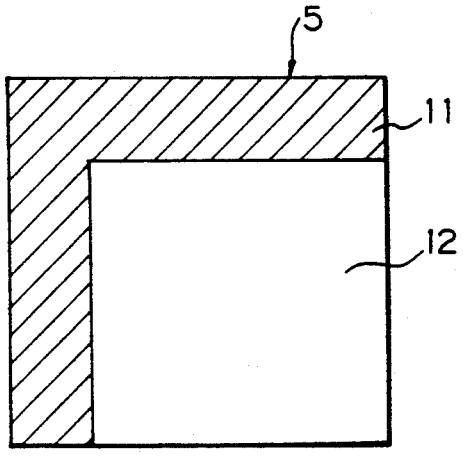
Figure 15:
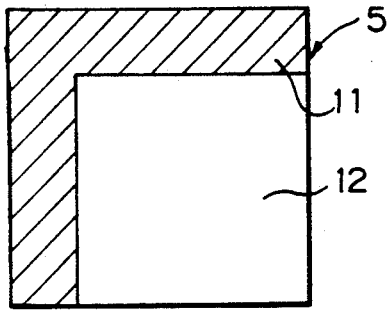
Figure 16:
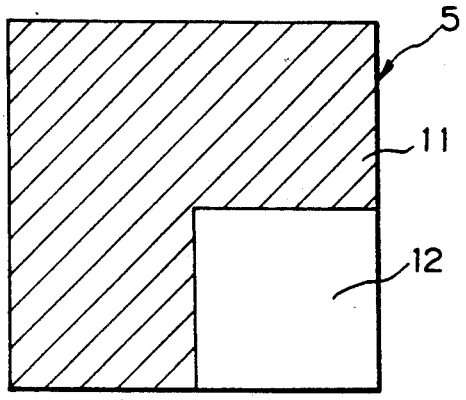
Figure 17:
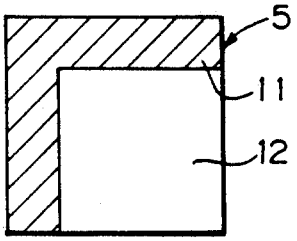
Figure 18:
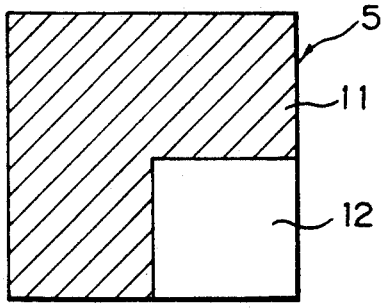
Figure 19:
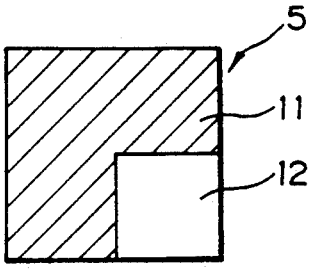

A number of developing rollers 5 were prepared each having the pattern shown in FIG. 8 and different from the others as to the widths $l_1$ and $l_2$, the pitch P, and the ratio S of the area of the dielectric body to the entire area of the unit portion shown in FIG. 13. Specifically, three different groups of conductive rollers 10 were produced by knurling, i.e., rollers having grooves at pitches of 0.5 mm, 0.4 mm, and 0.3 mm. Dielectric bodies 11 were buried in such grooves to thereby prepare three different groups, each of the developing rollers 5 was provided with ether one of area ratios S of 40% and 75%. As a result, six different kinds of developing rollers 5 were produced. FIGS. 14 through 19 each shows one unit of the surface pattern of respective one of the six different kinds of rollers 5. FIG. 14 shows a first developing roller having $P=0.5$, $l_1=0.11$ mm, $l_2=0.39$ mm, and $S=40\%$; FIG. 15 shows a second developing roller having $P=0.4$ mm, $l_1=0.09$ mm, $l_2=0.31$ mm, and $S=40\%$; FIG. 16 shows a third developing roller having $P=0.5$ mm, $l_1=0.25$ mm, $l_2=0.25$ mm, and $S=75\%$; FIG. 17 shows a fourth developing roller having $P=0.3$ mm, $l_1=0.07$ mm, $l_2=0.23$ mm, and $S=40\%$; FIG. 18 shows a fifth developing roller having $P=0.4$ mm, $l_1=0.2$ mm, $l_2=0.2$ mm, and $S=75\%$; and FIG. 19 shows a sixth developing roller having $P=0.3$ mm, $l_1=0.15$ mm, $l_2=0.15$ mm, and $S=75\%$. Such different kinds of rollers were used to develop solid toner images each having a substantial area, while the gap d was changed each time. The toner images were transferred to recording sheets and then fixed thereon.

Irregularities in the image reproduced on each recording sheet was measured at the interval of 100 μm by a density measuring device. The point of measurement was sized 0.1 mm×0.1 mm, i.e., the point of measurement was linearly moved over a toner image by more than 3 cm so as to measure the density at more than 300 points. Assuming that the image density (reflection density) is G, the image density is defined as follows. Assume that the quantity of light used to illuminate a point of measurement and the quantity of reflection are $H_1$ and $H_2$, respectively. Then, $H_2/H_1$ is representative of the degree of reflection H, and the degree of reflection H and the image density G have a relation $G=\log_{10}(1/H)$. Such image density data was subjected to Fourier transform to determine an amplitude corresponding to irregularities ascribable to the pattern of the developing roller 5. Then, the contribution rate of the pattern to irregularities was calculated on the basis of the deviation of the determined density from a mean density. The term "contribution rate" refers to a value produced by dividing the change in amplitude ascribable to the pattern by the total change in amplitude and then multiplying the quotient by 100. When the contribution rate is 10% to 20%, the irregularity ascribable to the pattern is not noticeable. However, when the contribution rate is greater than 20%, the irregularity is noticeable. The results of experiments are shown in Table 1 below. In Table 1, circles, triangles and crosses are representative of the contribution rates of lower than 10%, 10% to 20%, and higher than 20%, respectively.

TABLE 1

| | d = 0.08 mm | d = 0.12 mm | d = 0.16 mm | d = 0.20 mm |
|---|---|---|---|---|
| (i) 1ST ROLLER | X | X | X | ○ |
| (ii) 2ND ROLLER | X | X | Δ | ○ |
| (iii) 3RD ROLLER | X | Δ | ○ | ○ |
| (iv) 4TH ROLLER | X | Δ | ○ | ○ |
| (v) 5TH ROLLER | X | ○ | ○ | ○ |
| (vi) 6TH ROLLER | Δ | ○ | ○ | ○ |

Figure 20:
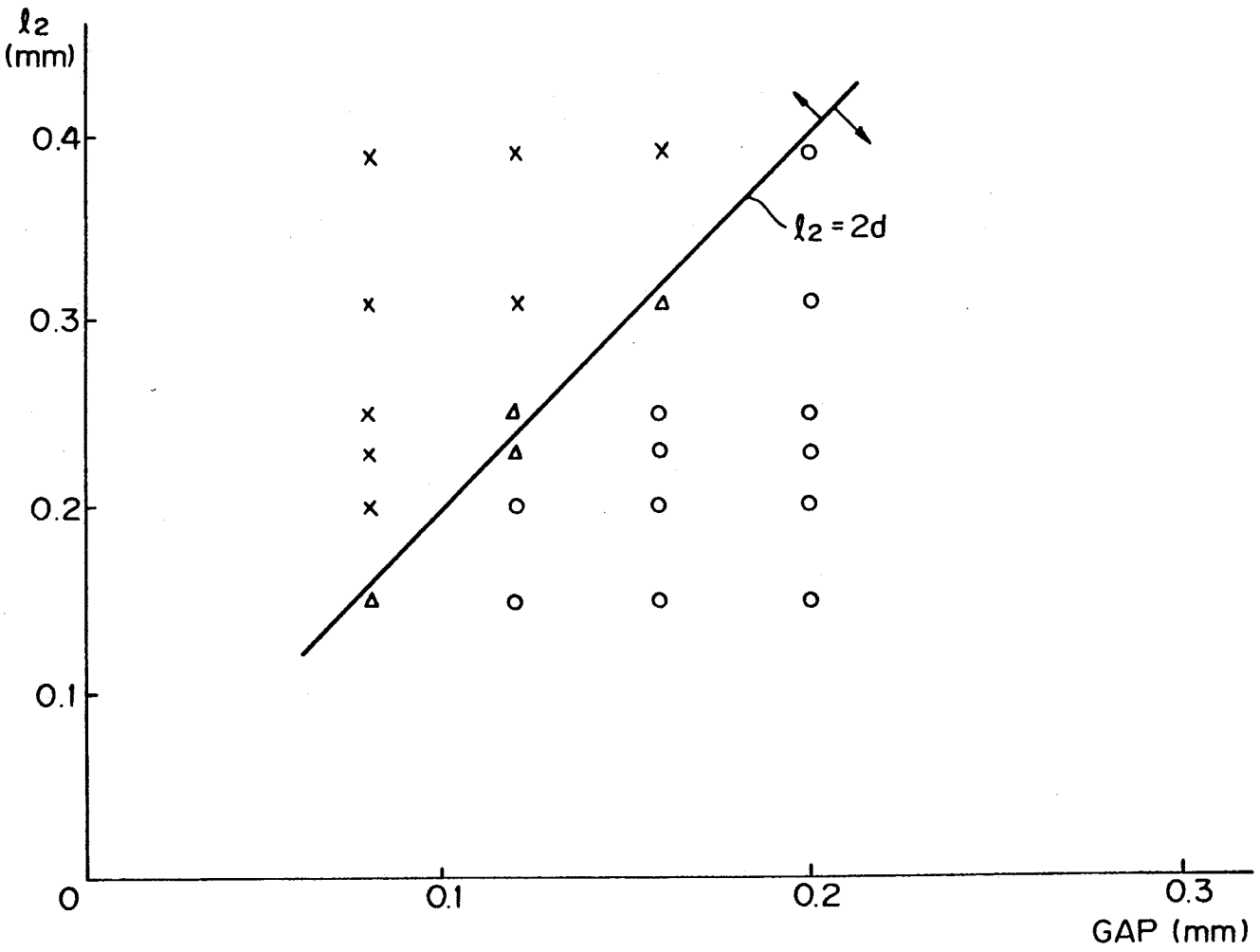
FIG. 20 is a graph of the gap and the width $L_2$ respectively from Table I concerning the contribution rate ascribable to the pattern by the total change in amplitude of image density.

As Table 1 indicates, the contribution rate, i.e., the irregularities of the toner image is not effected when only the pitch P of the pattern is changed. For example, despite that the first and third developing rollers (i) and (iii) both have the pitch P of 0.5 mm, the results are entirely different. Table 1 also indicates that changing only the area ratio S of the surfaces of the dielectric bodies is not successful in effecting the irregularities. For example, the results associated with the first and second developing rollers (i) and (ii) are different from each other despite that the two rollers have the same area ratio S, i.e., 40%. By contrast, the result greatly changes depending on the developing gap d. It is expected, therefore, that the irregularities will be eliminated if an optimal developing gap d is selected. On the other hand, the results associated with the third and fourth developing rollers (iii) and (iv) which have the same width $l_2$ are identical. Then, the width $l_2$ presumably is another decisive factor which influences the occurrences or the prevention of the irregularities. Based on such assumptions, we plotted the results shown in Table 1 in a graph whose abscissa and ordinate represented the gap d and the width $l_2$, respectively. FIG. 20 shows such a graph. As FIG. 20 indicates, there exist two different ranges W1 and W2 which are divided by a line $l_2=2\times d$. The irregularities are noticeable in the range W1 and not noticeable in the range W2.

It will be seen from the above that if a relation $d>l_2/2$ is satisfied, the toner deposited on the surfaces of the dielectric bodies 12 in as many as three to five layers can fly in the developing region 9 while scattering and deposit uniformly on the latent image formed on the drum 1. This frees the resultant toner image from traces ascribable to the patterm of the developing roller 5.

It will be apparent that the above-stated result is achievable with any other pattern such as the pattern shown in FIG. 3 or the pattern shown in FIG. 7. Again, it is desirable that the surfaces of the dielectric layers on the developing roller 5 be provided with an area ratio of 40% to 95%, preferably 60% to 80%. The construction described above is also applicable to a case wherein the dielectric bodies 11 are charged to the same polarity as the toner to cause the conductive surface portions 12 to retain the toner thereon, in which case a relation $d>l_2/2$ should be satisfied. Also, the area ratio of the conductive surface portions 12 should preferably be 60% to 80%.

When the configuration satisfying $d>l_2/2$ is combined with the previously stated configuration satisfying $P_1<D$, preferably $P_1\leqq D$, a further improved results is attainable.

Figure 21:
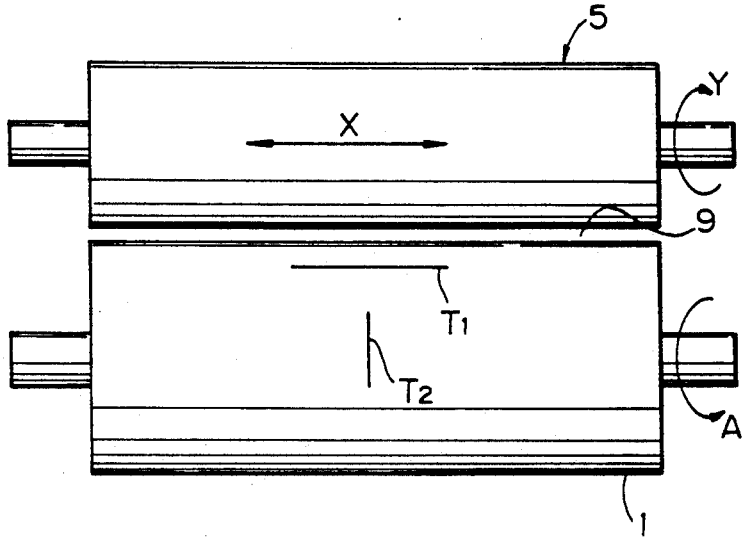
FIG. 21 illustrates the rotation of the developer roller and the drum.
Figure 22:
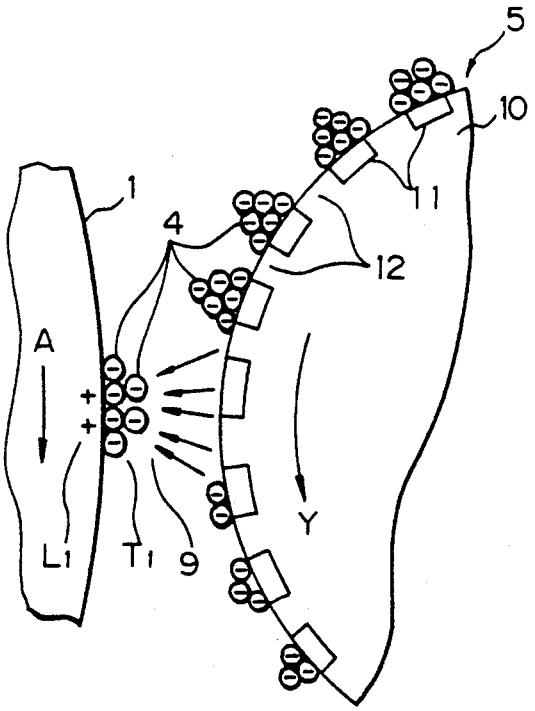
FIGS. 22 and 23 illustrate the action occurring along the line $T_1$ of FIG. 21 and $T_2$ of FIG. 21 respectively.
Figure 23:
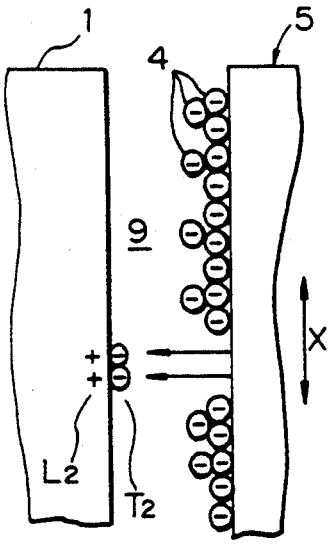
Figure 24:
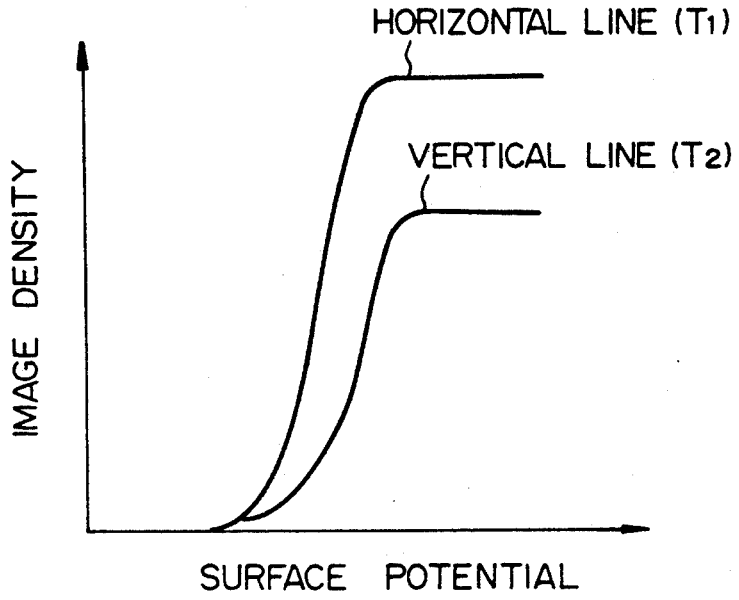
FIG. 24 is a graph of the image density and surface potential for the vertical and horizontal lines when pitch patterns P1 and P2 are not regulated.
Figure 25:
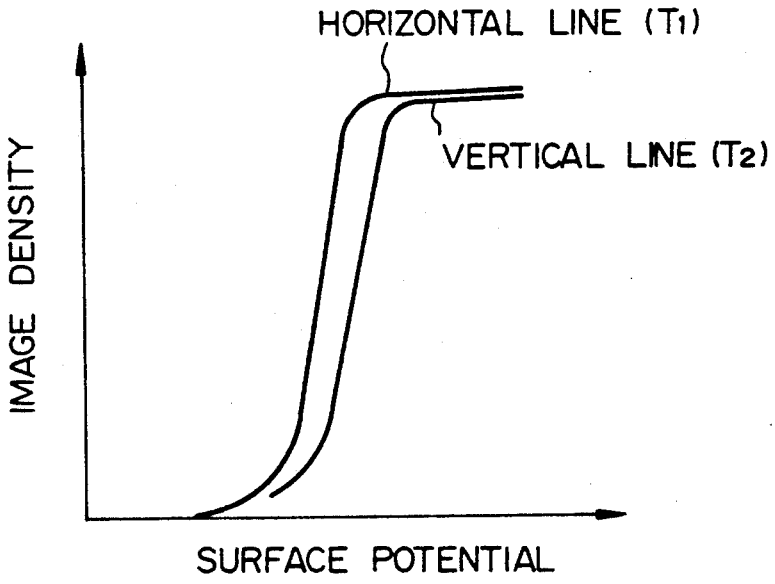
FIG. 25 is a graph of image density versus surface potential for the vertical and horizontal lines from the pitch pattern as regulated in accordance with the present invention.

When the developing roller 5 is rotated at the same or substantially the same linear velocity as the drum 1, the concentration of toner at the trailing edge of a latent image is eliminated, as stated earlier. However, the embodiments shown and described are apt to bring about the following problem. Specifically, FIG. 21 show the developing roller 5 and the drum 1 which are parallel to each other and spaced apart by a small gap. As shown in FIG. 21, assume that the portion of the drum 1 having passed the developing region 9 carries a toner image in the form of a line $T_1$ parallel to the axial direction X (hereinafter referred to as a horizontal line) and a toner image in the form of a line $T_2$ extending in the rotating direction A of the drum 1 (hereinafter referred to as a vertical line). Then, if the roller 5 rotating in the direction Y and carrying a great amount of toner thereon is rotated at substantially the same linear velocity as the drum 1 in the developing region 9, it is likely that the vertical line $T_2$ is lower in density than the horizontal line $T_1$ for the following reasons. FIGS. 22 and 23 show respectively the horizontal line $T_1$ and a latent image thereof $L_1$ (hereinafter referred to as a horizontal latent image) and the vertical line $T_2$ and a latent image thereof $L_2$ (hereinafter referred to as a vertical latent image). In FIG. 22, assume that the horizontal latent image $L_1$ has reached the developing region 9 as the drum 1 is rotated in a direction A. Then, the toner 4 deposited mainly on the surfaces of the dielectric bodies 11 of the developing roller 5 which is rotating in the direction Y flies to the positively charged latent image $L_1$ due to the electric fields developed between the roller 5 and the drum 1, thereby forming the horizontal line image $T_1$ by non-contact development. At this instant, the flight of toner to the latent image $L_1$ also occurs at the upper and lower portions of the drum 5 due to centrifugal force, as indicated by arrows in FIG. 22. As a result, a great amount of toner deposits on the latent image $L_1$ to increase the density of the line image $T_1$. By contrast, as shown in FIG. 23, no extra toner 4 flies to the vertical latent image $L_2$ from the right or the left (upper or lower portion as viewed in FIG. 23) with the result that the vertical line image $T_2$ is comparatively low in density. Consequently, as shown in FIG. 24, the horizontal and vertical line images $T_1$ and $T_2$ differ in density from each other, resulting in low resolution and, therefore, poor image quality. Exactly the same phenomenon is observed when the drum 1 is charged to the same polarity as the toner to effect so-called reverse development.

In light of the above, the illustrative embodiment forms the charge pattern at particular pitches on the developing roller 5 while using the configurations of the embodiments described above. A regular charge pattern matching the regular pattern of dielectric bodies 11 and conductive surface portions 12 is developed on the developing roller, as stated earlier and shown in FIG. 3. In this embodiment, the pattern has a pitch $P_1$ in the rotating direction Y of the roller 5 and a pitch $P_2$ in the axial direction X of the same. These pattern pitches $P_1$ and $P_2$ are so selected as to satisfy a relation $P_1 \leqq 2P_2$. When the dielectric bodies 11 extend in the particular directions Z and W shown in FIG. 3, the angle $\theta_1$ between the directions Z and W and the axial direction X of the roller 5 is selected to be greater than 60°. Then, the conductive surface portions 12 which do not or substantially do not retain the toner will be longer in the direction Y than in the direction X.

In the above configuration, when the toner carried on the developing roller 5 develops the horizontal latent image $L_2$ in the developing region 9, the flight of the toner in the up-and-down direction in FIG. 22 is suppressed. Conversely, in the event of development of the vertical latent image $L_2$, the flight of the toner in the right-and-left direction in FIG. 22 (up-and-down direction in FIG. 23) is promoted. Therefore, it is possible to reduce or fully eliminate the difference in density between the horizontal and vertical line images $T_1$ and $T_2$. It follows that a bias voltage whose frequency provides the best resolution with regard to a latent image having the smallest width can be applied to the roller 5.

FIG. 26 shows the dielectric bodies 11 arranged in a lattice configuration and extending in the rotating direction Y of the developing roller 5 (direction in which the surface of the roller 5 moves) and the axial direction X. FIG. 27 shows another specific configuration in which dot-like dielectric bodies 11 each having a rectangular, circular or any other suitable shape are arranged regularly in the directions Y and X of the roller 5. These configurations are also successful in achieving the above-described advantages only if the pitches $P_1$ and $P_2$ of the dielectric bodies 11, i.e., the charge pattern are selected to satisfy the relation $P_1 > 2P2$.

Again, the dielectric bodies 11 may be charged to the same polarity as the toner to cause the conductive surface portions 12 to carry the toner thereon. In such a case, the dielectric bodies 11 shown in FIG. 3, 26 or 27 are replaced with conductive surface portions while the conductive surface portions 12 are replaced with dielectric surface portions. These dielectric surface portions are charged to the same polarity as the toner so that the toner may deposit on the conductive surface portions. In this condition, the advantages described above are achievable only if the relation $P_1 \geqq P_2$ is set up.

In this particular embodiment, the area ratio of the conductive surface portions 12 to the developing roller 5 may be 20% to 80%, particularly 30% to 60%. In this manner, the numerical values such as the dimensions of the dielectric bodies 11 and conductive surface portions 12 regularly arranged on the roller 5 are suitably selected in matching relation to the particle size of toner, the field strength of microfields, etc.

In any of the embodiments shown and described, the developing roller 5 may be additionally provided with a dielectric layer of predetermined thickness such that it covers the surfaces of the dielectric bodies and the conductive surface portions. Then, the thickness and, therefore, the electrostatic capacity differs from a position where both of the dielectric body and dielectric layer exist to a position where only the dielectric layer exists. As a result, when the surface of the dielectric layer is charged by the toner supply roller 6, a potential difference is developed on the surface of the roller 5 on the basis of the difference in electrostatic capacity, producing numerous microfields in close proximity to the surface of the roller 5.

It is to be noted that the toner supply roller 6 is a specific form of means for charging the dielectric bodies 11 or the above-mentioned dielectric layer to predetermined polarity. If desired, the toner supply roller 6 may be replaced with an independent frictional charging member, corona discharger, member for injecting charges in contact with the toner carrier, or similar conventional charging means.

While the present invention has been shown and described in relation to a developing apparatus of the type using a non-magnetic toner, i.e., a one-component developer optimal for, among others, color development, it is similarly applicable to an apparatus of the type operable with a one-component developer implemented as a magnetic toner with or without an auxiliary agent.

In summary, it will be seen that the present invention provides a developing apparatus capable of transporting a necessary amount of sufficiently charged toner to a developing region to form a toner image in desired density and causing the toner to scatter in the developing region. The apparatus, therefore, prevents irregularities corresponding to the pattern of dielectric bodies and conductive surface portions provided on a toner carrier from appearing on a toner image. In addition, the apparatus of the present invention eliminates the occurrence that a line image extending in the moving direction of the surface of the toner carrier and a line image extending in the axial direction noticeably differ in density from each other.

Various modifications will become possible for those skilled in the art after receiving the teachings of the present disclosure without departing from the scope thereof.

What is claimed is:

1. A developing apparatus comprising:

a movable developer carrier which has a mixture of conductive surface, dielectric surface portions on the surface of said carrier and wherein said surface selectively holds a charge to thereby form a plurality of microfields and wherein said surface electrostatically retains a developer due to said plurality of microfields;

an image carrier wherein said image carrier faces said developer carrier in a developing region wherein in said developing region a latent image electrostatically formed on said image carrier is developed by said developer, wherein said developer carrier and said image carrier forming said developing region are spaced apart by a predetermined developing gap such that in said developing region, said developer retained on said surface of said developer carrier electrostatically flies to said latent image to develop said latent image wherein said surface of said developer carrier has a pattern with a pitch $P_2$ constituted by said conductive and dielectaric surface portions and, wherein said developer carrier and said image carrier each comprise a drum and satisfy a relation $$P_1 \leqq \sqrt{Rrd} / \sqrt{2(R + r)}$$

where r and R are respectively diameters of said developer carrier and said image carrier, and d is said developing gap.

2. An apparatus as claimed in claim 1, wherein said dielectric surface portions of said developer carrier are charged to opposite polarity of said developer to cause said developer to deposit on said dielectric surface portions.

3. An apparatus as claimed in claim 2, wherein, assuming that said conductive surfaces of said developer carrier each has a width of $l_2$, and that said developing gap is d, a relation $d > l_2/2$ is satisfied.

4. An apparatus as claimed in claim 2, wherein said dielectric surface portions of said developer carrier occupy 40% to 95% of said surface of said developer carrier in terms of area.

5. An apparatus as claimed in claim 1, wherein said dielectric surface portions of said developer carrier are charged to the same polarity as said developer to cause said developer to deposit on said conductive surface portions.

6. An apparatus as claimed in claim 5, wherein assuming that said dielectric surfaces each has a width $l_2$, and that said developing gap is d, a relation $d > l_2/2$ is satisfied.

7. An apparatus as claimed in claim 5, wherein said conductive surface portions of said developer carrier occupy 40% to 95% of said surface of said developer carrier.

8. An apparatus as claimed in claim 1, further comprising a dielectric layer provided on said surface of said developer carrier.

* * * * *